US007389979B2

(12) United States Patent
Kaneko

(10) Patent No.: US 7,389,979 B2
(45) Date of Patent: Jun. 24, 2008

(54) SHEET PROCESSING APPARATUS AND METHOD

(75) Inventor: Tamaki Kaneko, Fujisawa (JP)

(73) Assignee: Kaneko Co., Ltd., Kanagawa-ken (JP)

( * ) Notice: Subject to any disclaimer, the term of this patent is extended or adjusted under 35 U.S.C. 154(b) by 232 days.

(21) Appl. No.: 11/168,976

(22) Filed: Jun. 27, 2005

(65) Prior Publication Data

US 2006/0012099 A1 Jan. 19, 2006

(30) Foreign Application Priority Data

Jul. 16, 2004 (JP) ..... 2004-209348

(51) Int. Cl.
*B65H 37/04* (2006.01)

(52) U.S. Cl. ..... 270/58.07; 270/58.08; 270/58.09; 270/58.11; 270/58.13; 270/37

(58) Field of Classification Search ..... 270/37, 270/58.07, 58.08, 58.09, 58.11, 58.13; 271/213, 271/215, 217, 218, 221
See application file for complete search history.

(56) References Cited

U.S. PATENT DOCUMENTS 5,112,034 A * 5/1992 Uto et al. ..... 270/58.12
5,832,358 A * 11/1998 Sampath et al. ..... 399/405
6,450,492 B1 * 9/2002 Coombs et al. ..... 270/58.08
6,729,612 B2 * 5/2004 Nagao et al. ..... 270/37
6,819,906 B1 * 11/2004 Herrmann et al. ..... 399/368
2002/0060415 A1 * 5/2002 Kaneko ..... 271/221
2004/0262832 A1 * 12/2004 Kaneko ..... 270/58.08
2006/0012098 A1 * 1/2006 Kaneko ..... 270/37
2006/0038336 A1 * 2/2006 Hirata et al. ..... 270/37

FOREIGN PATENT DOCUMENTS

JP 60248565 A * 12/1985
JP 09110285 A * 4/1997

* cited by examiner

*Primary Examiner*—Gene O. Crawford
*Assistant Examiner*—Leslie A Nicholson, III
(74) *Attorney, Agent, or Firm*—Cooper & Dunham LLP

(57) ABSTRACT

A sheet processing apparatus receives sheets discharged from an image forming apparatus one after another on a binding tray to be stacked on top of another, jogs each sheet as the sheet is received on the binding tray, binds a set of the sheets on the binding tray with a binding device, and discharges the bound set of the sheets from the binding tray. Sheets received from the image forming apparatus one after another after the binding device has started binding the set of the sheets on the binding tray and before the binding tray has returned from a discharging position to a receiving position are received one after another, stacked on top another and held on a sheet holding device. The sheet holding device releases the held sheets to be fallen and received on the binding tray after the binding tray has returned to the receiving position.

15 Claims, 14 Drawing Sheets

SHEET PROCESSING APPARATUS AND METHOD

CROSS-REFERENCE TO RELATED APPLICATIONS

The present application claims priority and contains subject matter related to Japanese Patent Application No. 2004-209348 filed in the Japanese Patent Office on Jul. 16, 2004 and the entire contents of which are hereby incorporated herein by reference.

BACKGROUND OF THE INVENTION

1. Field of the Invention

The present invention relates to a sheet processing apparatus binding a received set of sheets, and in particular relates to a sheet processing apparatus used in conjunction with an image forming apparatus, such as a copying machine, a printer, etc.

2. Discussion of the Background

A sheet processing apparatus used in conjunction with an image forming apparatus, such as a copying machine, a printer, etc., receives sheets discharged from the image forming apparatus one after another, stacks and jogs the sheets, and performs processing, such as punching and/or binding, to the sheets.

In a system in which a sheet processing apparatus is connected with an image forming apparatus, it is known that when the speed of processing sheets of the sheet processing apparatus, such as jogging, punching and/or binding the sheets, is not comparable to the speed of forming images of the image forming apparatus, the image forming apparatus is controlled to stop forming images temporarily while the sheet processing apparatus is performing, for example, a binding operation.

It is also known to arrange a sheet waiting apparatus between a sheet processing apparatus and an image forming apparatus to avoid that the image forming apparatus is caused to temporarily stop forming images. Sheets discharged from the image forming apparatus one after another while the sheet processing apparatus is performing a binding operation to a previously received set of sheets are temporarily held at the sheet waiting apparatus, and the sheets are conveyed to the sheet processing apparatus after the binding operation to the previously received set of sheets has been completed at the sheet processing apparatus.

Further, in a system in which a sheet processing apparatus is connected with an image forming apparatus, when a malfunction has occurred at the sheet processing apparatus, the image forming apparatus is generally caused to stop operating. In this case, sheets remained in the sheet conveyance path of the image forming apparatus must be removed before restarting the sheet processing apparatus.

Furthermore, in such a sheet processing apparatus used in conjunction with an image forming apparatus, after a set of sheets has been bound, the bound set of sheets is discharged onto a discharge tray of the apparatus. In processing a plurality of sets of sheets one after another, the plurality of sets of sheets, each having been bound, are stacked on top of another on the discharge tray, so that when the bound set of sheets is thin, separating one from the other is relatively hard.

SUMMARY OF THE INVENTION

The present invention has been made in view of the above-discussed and other problems and addresses the above-discussed and other problems.

Preferred embodiments of the present invention provide a novel sheet processing apparatus for use in conjunction with an image forming apparatus, in which sheets received from the image forming apparatus while binding and discharging a previously received set of sheets is being performed are held to be conveyed to a binding tray, so that the image forming apparatus is avoided from being temporarily stopped to form images and thereby from being decreased in the productivity.

The preferred embodiment of the present invention further provides a novel sheet processing apparatus for use in conjunction with an image forming apparatus, in which each bound set of sheets on a binding tray is shifted, before being discharged from the binding tray, to one or the other side of the binding tray in the widthwise direction of the binding tray, so that a plurality of bound set of sheets, discharged from the binding tray one after another, are stacked on top of another on a discharge tray shifted to alternate sides of the discharge tray and thereby separating one from another is facilitated.

According to an embodiment of the present invention, a sheet processing apparatus is provided. A receiving device is configured to receive sheets discharged from an image forming apparatus one after another and to convey the sheets, and includes a discharge roller pair to discharge the sheets from the receiving device one after another. A binding tray is configured to receive the sheets discharged from the receiving device one after another to be stacked on top of another thereon, and includes a widthwise jogging device configured to move between a jogging position and a criterion position to jog each sheet received on the binding tray, as the sheet is received thereon, at widthwise sides of the sheet in a direction in which the sheet has been conveyed by the receiving device. A binding device is configured to bind a set of the sheets received, stacked, and jogged on the binding tray, and a discharge device is configured to discharge the bound set of the sheets from the binding tray. The binding tray is configured to be located in a receiving position when receiving the sheets discharged from the receiving device one after another thereon to be stacked on top of another and jogging each sheet received on the binding tray with the widthwise jogging device as the sheet is received thereon and when the set of the sheets received, stacked, and jogged on the binding tray is bound by the binding device, to be moved to a discharging position when discharging the bound set of the sheets from the binding tray, and to be returned to the receiving position after the bound set of the sheets has been discharged from the binding tray. The sheet processing apparatus further includes a sheet holding device arranged between the discharge roller pair of the receiving device and the binding device. The sheet holding device is configured to receive sheets, discharged from the receiving device one after another after the binding device has started binding the set of the sheets on the binding tray and before the binding tray has returned from the discharging position to the receiving position, one after another to be stacked on top of another and to be held thereon, and to release the held sheets to be fallen and received on the binding tray after the binding tray has returned from the discharging position to the receiving position.

In the above-described sheet processing apparatus, the sheet holding device may be configured to retreat to release the held sheets to be fallen and received on the binding tray.

Further, the sheet holding device may be configured such that trailing end sides of the sheets, discharged from the receiving device one after another after the binding device has started binding the set of the sheets on the binding tray and before the binding tray has returned from the discharging position to the receiving position, are received and held thereon. In this case, the widthwise jogging device of the binding tray may include upper plates and may be configured such that leading end sides of the sheets, discharged from the receiving device one after another after the binding device has started binding the set of the sheets on the binding tray and before the binding tray has returned from the discharging position to the receiving position, are received and held on the upper plates of the widthwise jogging device. Further, in this case, the widthwise jogging device of the binding tray may be configured to be in the jogging position to hold the set of the sheets on the binding tray when the set of the sheets on the binding tray is bound by the binding device and to be returned to the criterion position after the binding tray has returned to the receiving position after the bound set of the sheets has been discharged from the binding tray.

Furthermore, in the above-described sheet processing apparatus, the binding tray may include a lengthwise jogging device configured to jog each sheet received on the binding tray as the sheet is received on the binding tray in the direction in which the sheet has been conveyed by the receiving device, and the binding device may include an opening part into which a trailing end side portion of each sheet received on the binding tray is put into when the sheet is jogged by the lengthwise jogging device. In this case, the sheet holding device may be configured to prevent trailing end side portions of the received and held sheets from being put into the opening part of the binding device.

Still further, in the above-described sheet processing apparatus, the widthwise jogging device of the binding tray may include widthwise jogging members configured to move between respective criterion positions and widthwise jogging positions to jog each sheet received on the binding tray at the widthwise sides of the sheet as the sheet is received on the binding tray and individual drive devices configured to drive the widthwise jogging members to move between respective criterion positions and widthwise jogging positions. The widthwise jogging members may be configured to be driven to move substantially at the same time in the same direction in the widthwise direction of the binding tray in the direction in which the bound set of the sheets is discharged from the binding tray to shift the bound set of the sheets on the binding tray to one or the other side of the binding tray in the widthwise direction of the binding tray. Further, when binding a plurality of sets of sheets in series one after another, after the plurality of set of sheets have been bound by the binding device one after another, the widthwise jogging members may be moved in alternate directions in the widthwise direction of the binding tray, so that the plurality of sets of sheets are shifted to alternate sides of the binding tray in the widthwise direction of the binding tray before being discharged from the binding tray one after another.

Still further, in the above-described sheet processing apparatus, when the bound set of the sheets has not been discharged from the binding tray in a predetermined period of time, an instruction may be sent to the image forming apparatus to stop forming images for a subsequent set of sheets following the next set of sheets following the bound set of the sheets, so that the next set of sheets following the bound set of the sheets, discharged from the image forming apparatus, is received and held on the sheet holding device. In this case, the sheet holding device may be configured to release the next set of sheets received and held thereon to be fallen and received on the binding tray when the apparatus has restarted to operate.

According to another embodiment of the present invention, a method of processing sheets in a sheet processing apparatus is provided. The method includes receiving sheets discharged from an image forming apparatus one after another on a tray to be stacked on top of another and jogging each sheet as the sheet is received on the tray; binding a set of the sheets received, stacked, and jogged on the tray; discharging the bound set of the sheets from the tray; receiving and holding sheets, discharged from the image forming apparatus one after another after the binding the set of the sheets on the tray has started and before the discharging the bound set of the sheets from the tray has been completed, on a holding device to be stacked on top of another thereon; and releasing the sheets held on the holding device to be fallen and received on the tray, after the discharging the bound set of the sheets from the tray has been completed.

The method may further include shifting the bound set of the sheets on the tray, before discharging the bound set of the sheets from the tray, to one or the other side of the tray in a widthwise direction of the tray in a direction in which the bound set of the sheets is discharged from the tray. Further, when processing a plurality of sets of sheets in series one after another, in the shifting, the plurality of sets of sheets may be shifted to alternate sides of the tray in the widthwise direction of the tray.

Further, the method may further include instructing the image forming apparatus to stop forming images for a subsequent set of sheets following the next set of sheets following the bound set of the sheets, when the bound set of the sheets has not been discharged from the tray within a predetermined period of time in the discharging.

BRIEF DESCRIPTION OF THE DRAWINGS

A more complete appreciation of the present invention and many of the attended advantages thereof will be readily obtained as the present invention becomes better understood by reference to the following detailed description when considered in connection with the accompanying drawings, wherein.

DETAILED DESCRIPTION OF THE PREFERRED EMBODIMENTS

Figure 1:
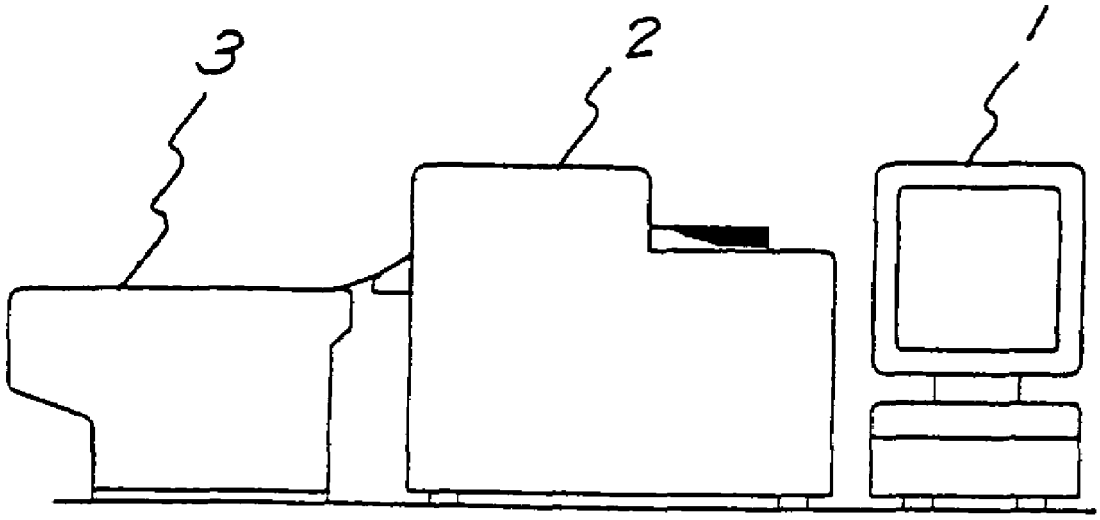
FIG. 1 is a diagram schematically illustrating a system in which a sheet processing apparatus according to an embodiment of the present invention is connected with an image forming apparatus controlled by an image formation controller.

Referring now to the drawings, wherein like reference numerals designate identical or corresponding parts throughout the several views, preferred embodiments of the present invention are described.

FIG. 1 illustrates a system in which a sheet processing apparatus according to an embodiment of the present invention is connected with an image forming apparatus controlled by an image formation controller.

A printer 2 as an example of the image forming apparatus includes a sheet feeding device accommodating sheets and feeding the sheets one by one, and is configured to form an image of image data of a page of a document, sent from a PC 1 serving as the image formation controller, on each sheet conveyed from the sheet feeding device, according to an instruction from the PC 1, Generally, the printer 2 forms the image on the sheet using an ink jet process or electrophotography. A sheet processing apparatus 3 as the sheet processing apparatus of the present invention receives sheets discharged from the printer 2 one after another. Various settings, such as setting of pages of a document, setting of the number of sets of the document to be produced, setting of binding positions in the document, etc., are performed at the PC 1.

Figure 2:
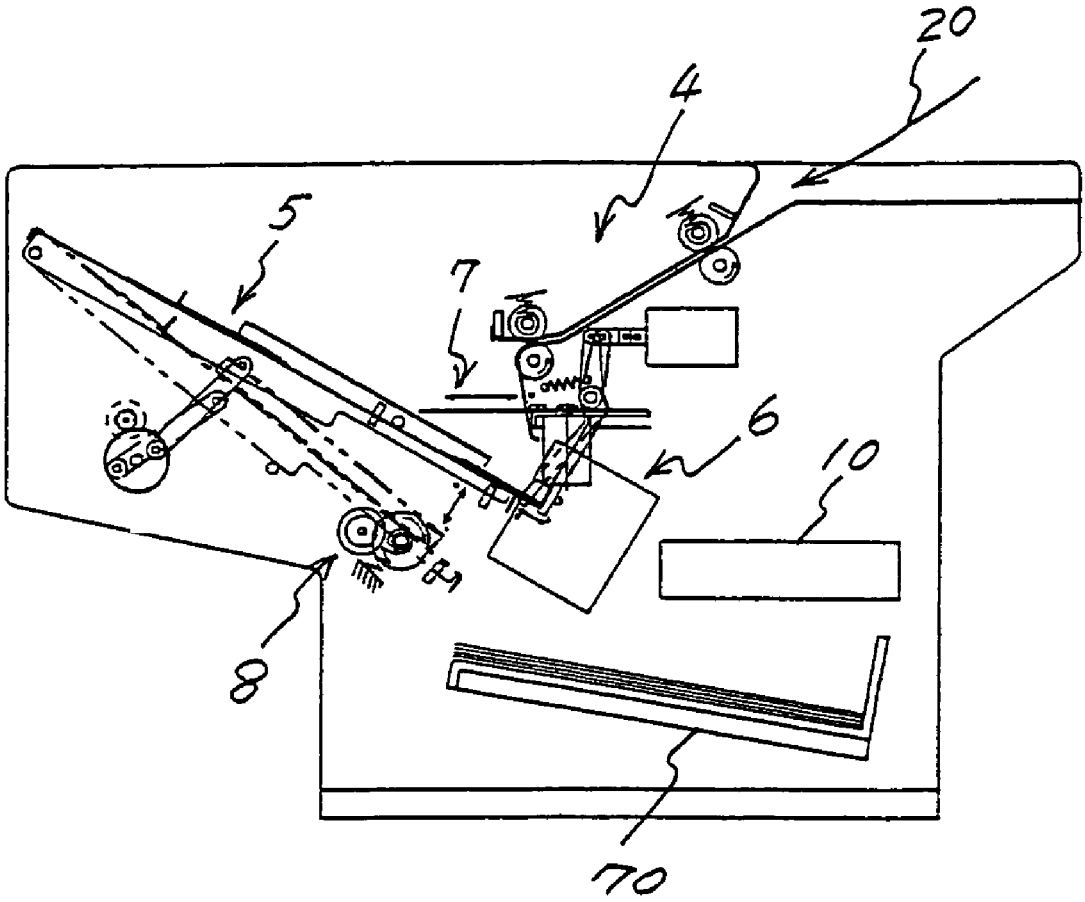
FIG. 2 is a diagram schematically illustrating an exemplary construction of the sheet processing apparatus.

FIG. 2 illustrates an exemplary construction of the sheet processing apparatus 3.

The sheet processing apparatus 3 includes a receiving part 4 serving as a receiving device of the present invention, a jogging part 5 serving as a binding tray of the present invention, a binding part 6 serving as a binding device of the present invention, a waiting part 7 serving as a sheet holding device of the present invention, and a discharging part 8 serving as a discharge device of the present invention. The receiving device 4 receives sheets discharged from the printer 2 one after another and conveys the sheets further to be discharged, the jogging part 5 receives, stacks, and jogs the sheets discharged from the receiving part 4 one after another, the binding part 6 binds a stack of the sheets received, stacked and jogged on the jogging part 5, the waiting part 7 receives and holds sheets discharged from the receiving part 4 one after another after the binding part 6 has started binding the stack of the sheets on the jogging part 5 (as described later), the discharging part 8 discharges the bound stack of the sheets from the jogging part 5 onto a discharge table 70, and a control part 10 controls operations of the sheet processing apparatus 3.

Figure 3:
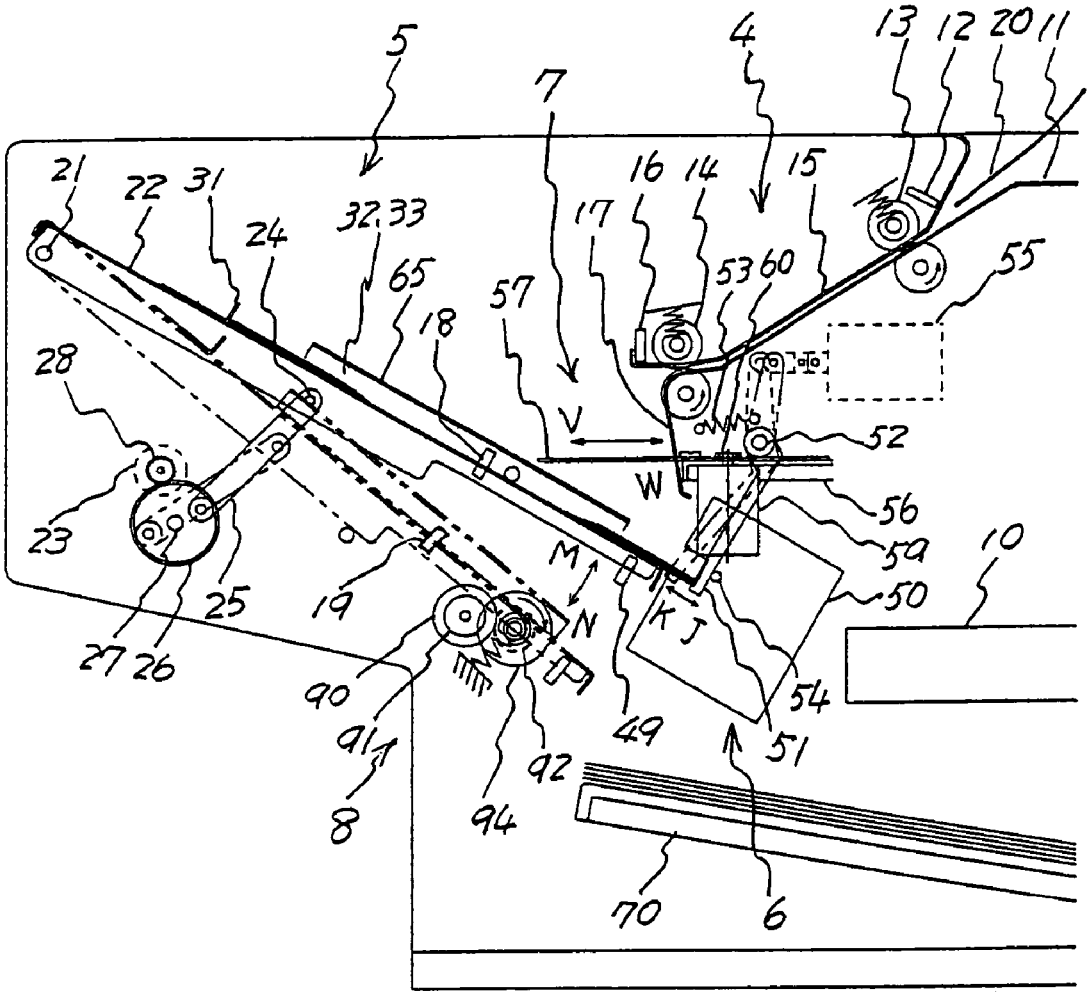
FIG. 3 is a cross section of the sheet processing apparatus for explaining the construction of the sheet processing apparatus.

FIG. 3 is a diagram for explaining the construction of the sheet processing apparatus 3.

The receiving part 4 includes a receiving table 11 configured to receive a sheet 20 discharged from the printer 2, an entry detector 12 configured to detect the received sheet 20, an entry roller pair 13 to convey the received sheet 20, a conveyance path 15 configured to guide the sheet 20, a discharge roller pair 14 configured to discharge the sheet 20 from the receiving part 4 to be fallen on the jogging part 5, a discharge detector 16 configured to detect a trailing edge of the sheet 20 discharged by the discharge roller pair 14, and a front plate 17 arranged to face the jogging part 5. The entry roller pair 13 and the discharge roller pair 14 are driven by a drive motor (not shown) to rotate in arrow directions in FIG. 3.

The jogging part 5 includes a binding tray 22 configured to swing around a support axis 21 fixed to side plates of the main body of the sheet processing apparatus 3, a pin 24 fixed to side faces of the binding tray 22, and a link 25 rotatably connected with the pin 24 at one end thereof. The other end of the link 24 is connected with a pin of a gear 26. The gear 26 is fixed to an axis 27 supported with bearings by the side plates of the main body of the sheet processing apparatus 3. With rotation of a motor 23, a gear 28 integrated with a motor axis of the motor 23 is rotated, so that the link 25 is moved, and thereby the binding tray 22 is swung around the support axis 21.

The binding tray 22 is positioned at an upper position M illustrated in the solid line in FIG. 3 and a lower position N illustrated in the two-dot-dashed line in FIG. 3 by controlling of the motor 23 according to detection of the binding tray 22 with an upper position sensor 18 and a lower position sensor 19.

Figure 4:
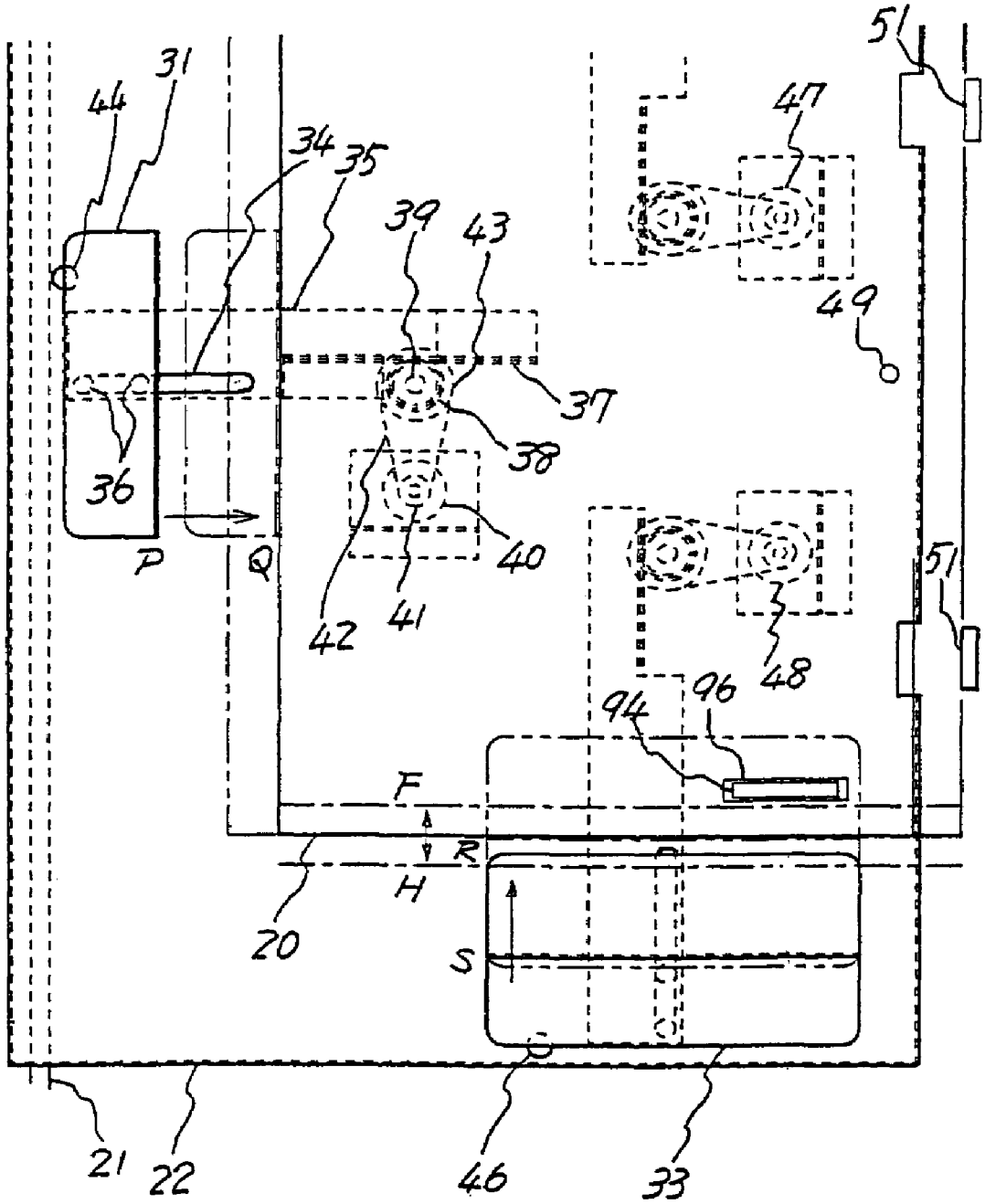
FIG. 4 is a diagram for explaining an upper plane of a binding tray of the sheet processing apparatus.

FIG. 4 is a diagram for explaining an upper plane of the binding tray 22. The binding tray 22 includes an end plate 31 serving as a lengthwise jogging device of the present invention and jogging the sheet 20 to be aligned in the direction in which the sheet 20 is conveyed, and a right side guide plate 32 and a left side guide plate 33 arranged at side parts of the binding tray 22 as widthwise jogging members for jogging the sheet 20 at both sides of the sheet 20 to be aligned in the widthwise direction of the sheet 20. Only the left side guide plate 33 is illustrated in FIG. 4. The end plate 31, the right side guide plate 32, and the left side guide plate 33 are driven to move by respective motors 40, 47 and 48 arranged at the rear side of the binding tray 22.

A slider 35 is fixed to the rear side of the end plate 31 by pins 36 penetrating through a guide hole 34 formed in the binding tray 22, and the end plate 31 is moved along the guide hole 34. A rack 37 is formed in the slider 35 and is engaged with a pinion 38. The pinion 38 is rotatably mounted to an axis 39 fixed to the binding tray 22. A pulley 43 integrated with the pinion 38 is rotated by a pulley 41, mounted to the motor 40, and a belt 42, and thereby the end plate 31 is moved between a position P in FIG. 4, which is the criterion position of the end plate 31 for movement, and a position Q in FIG. 4, which is a rear end position of the sheet 20 when the sheet 20 has been aligned for binding. A position sensor 44 is arranged to detect the end plate 31 when the end plate 31 has been moved to the position P.

Although the right side guide plate 32 is not shown in FIG. 4, the left side guide plate 33 and the right side guide plate 32 are moved between respective criterion positions S and jogging positions R to align the sheet 20 in the widthwise direction of the sheet 20. The left side guide plate 33 is moved by a left side position sensor 46 and the left side motor 48, and the right side guide plate 32 is moved by a right side position sensor 45 (not shown) and the right side motor 47, in a similar manner as the end plate 31 is moved.

Further, according to an instruction from the controller 10, the left side guide plate 33 and the right side guide plate 32 are moved at the same time in the same direction, to respective rear side positions F or front side positions H, to shift the bound stack of the sheets 20 on the binding tray 22 to the rear or the front side of the binding tray 22. Thereby, the bound stack of the sheets 20 is discharged from the binding tray 22 onto the discharge table 70 shifted to the rear or the front side of the discharge table 70. For example, if the rear side positions F and the front side positions H are separated from the jogging positions R 10 mm, respectively, by moving the left side guide plate 33 and the right side guide plate 32 to respective rear side positions F relative to the first bound stack of the sheets 20 and to respective front side positions H relative to the next bound stack of the sheets 20, the first bound stack of the sheets 20 and the next bound stack of the sheets 20 stacked one upon the other on the discharge table 70 are offset 20 mm on the discharge table 70.

When binding a plurality of sets of the sheets 20 in series one after another, the left side guide plate 33 and the right side guide plate 32 are moved to the rear side positions F and to the front side positions H, alternately, so that the plurality of sets of the sheets 20, discharged from the binding tray 22 one after another after having been bound with the stapler 50, are stacked on top another on the discharge table 70 shifted to alternate sides of the discharge table 70 in the widthwise direction of the discharge table 70. Thereby, even when each bound stack of the sheets 20 is thin, separating one from another is relatively easy.

Figure 5:
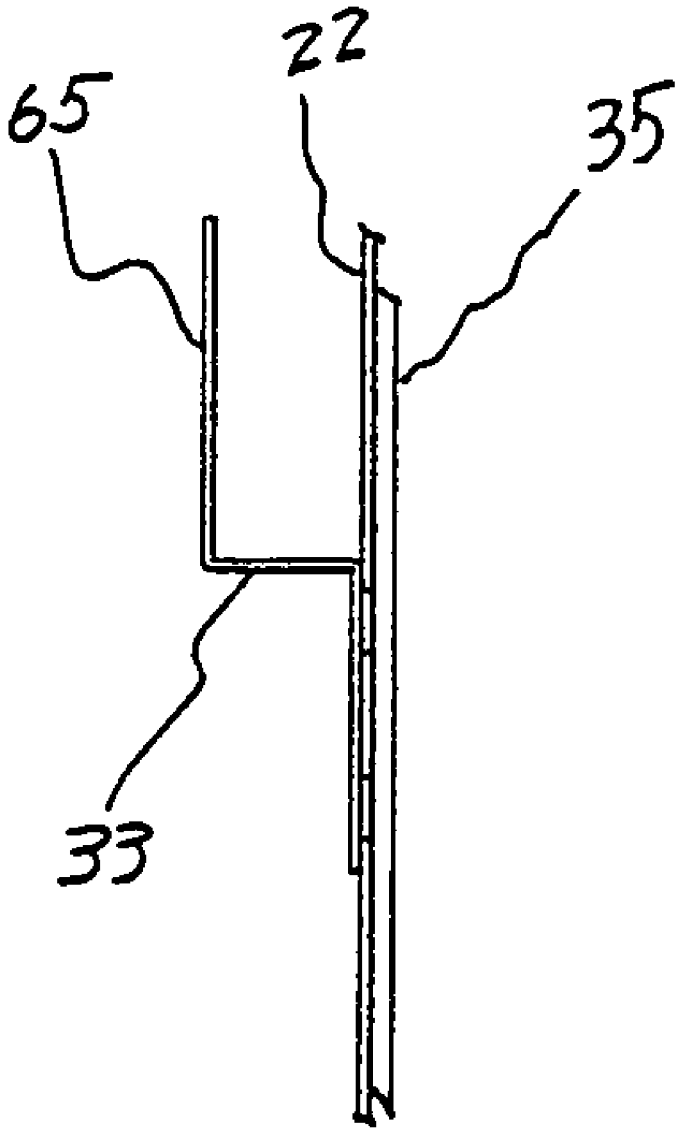
FIG. 5 is a cross section of a left side guide plate arranged on the binding tray.

FIG. 5 is a cross section of the left side guide plate 33. As illustrated in FIG. 5, the left side guide plate 33 includes an upper plate 65. Similarly, the right side guide plate 32 includes an upper plate 65. The left side guide plate 33 and the right side guide plate 32 are in the jogging positions R when binding a stack of the sheets 20 on the binding tray 22 with the binding part 6 and remain in the jogging positions R thereafter until the binding tray 22 returns to the upper position M after discharging the bound stack of the sheets 20 from the binding tray 22, so that the leading end side of the sheet 20 discharged by the discharge roller pair 14 of the receiving part 4 after binding the stack of the sheets 20 on the binding tray 22 has been started slides over the upper plates 65 of the left side guide plate 33 and the right side guide plate 32. At this time, the trailing end side of the sheet 20 is received by the waiting part 7 as described later.

Returning back to FIG. 4, a sheet detector 49 is arranged at the center of an end part of the binding tray 22 at the side of the binding part 6 to detect the existence of the sheet 20 on the binding tray 22. When a bound stack of the sheets 20 on the binding tray 22 is discharged from the binding tray 22, the sheet detector 49 detects the trailing edge of the bound stack of the sheets 20, and thereby discharging of the bound stack of the sheets 20 from the binding tray 22 is confirmed.

The binding part 6 includes a stapler 50 having an opening part into which the trailing end portion of each sheet 20 (in the direction in which the sheet 20 has been conveyed by the receiving part 4) is put when the sheet 20 received on the binding tray 22 is jogged by the end plate 31 on the binding tray 22, a stopper 51 for aligning the trailing end of the sheet 20 on the binding tray 22, and an axis 52 supported by the side plates of the main body with bearings to serve as a rotation center of the stopper 51. The stopper 51 is usually positioned in a position J illustrated in the solid line in FIG. 3 by a spring 53 and a positioning pin 54 so that the trailing end of the sheet 20 is aligned, and after binding a stack of the sheets 20 on the binding tray 22 with the stapler 50, with an operation of a solenoid 55, the axis 52 is rotated, so that the stopper 51 is moved to a position K illustrated in the two-dot-dashed line in FIG. 3. Thereby, the bound stack of the sheets 20 on the binding tray 22 is pushed back by the stopper 51 and the trailing end portion of the bound stack of the sheets 20 comes out of the opening part of the stapler 50.

Figure 6:
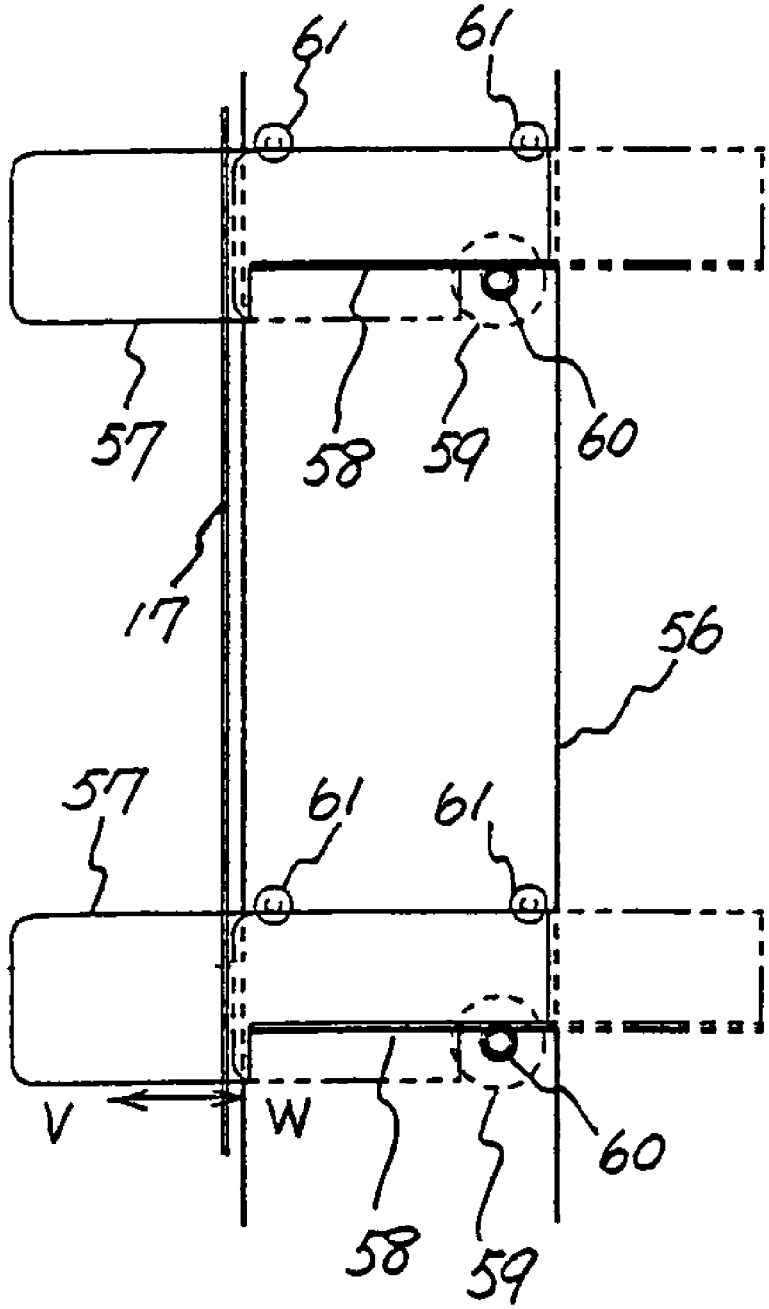
FIG. 6 is a plane view of a waiting part of the sheet processing apparatus.

The waiting part 7 is arranged, as illustrated in FIG. 3, above the opening part of the stapler 50, between the discharge roller pair 14 of the receiving part 4 and the stapler 50. FIG. 6 is a plane view of the waiting part 7. The waiting part 7 includes, as illustrated in FIG. 6, a mounting table 56 fixed to the side plates of the main body, and receiving plates 57 configured to move in the arrow directions in FIG. 6 on the mounting table 56. Racks 58 are formed in respective receiving plates 57, and the racks 58 are engaged with pinions 60, which are fixed to receiving plate motors 59 fixed to the mounting table 56. Guides 61 are formed in respective receiving plates 57 so that the receiving plates 57 move in the arrow directions in FIG. 6. With rotation of the receiving plate motors 59, the receiving plates 57 are moved, while protruding through holes provided in the front plate 17, to sheet receiving positions V illustrated in the solid lines in FIG. 6 (the positions that tip ends of the receiving plates 57 are above the binding tray 22 as illustrated in FIG. 3), and are returned to retreated positions W behind the front plate 17, illustrated in the two-dot-dashed lines in FIG. 6. The trailing end side of the sheet 20 discharged by the discharge roller pair 14 when the receiving plates 57 are in the receiving positions V is received on the receiving plates 57, so that the trailing end of the sheet 20 is prevented from being put into the opening part of the stapler 50, and the leading end side of the sheet 20 is received on the upper plates 65 of the left side guide plate 33 and the right side guide plate 32 of the binding tray 22.

In this embodiment, the sheet processing apparatus 3 includes a plural pieces of the receiving plate 57, however, may include a single piece of the receiving plate 57.

Figure 7:
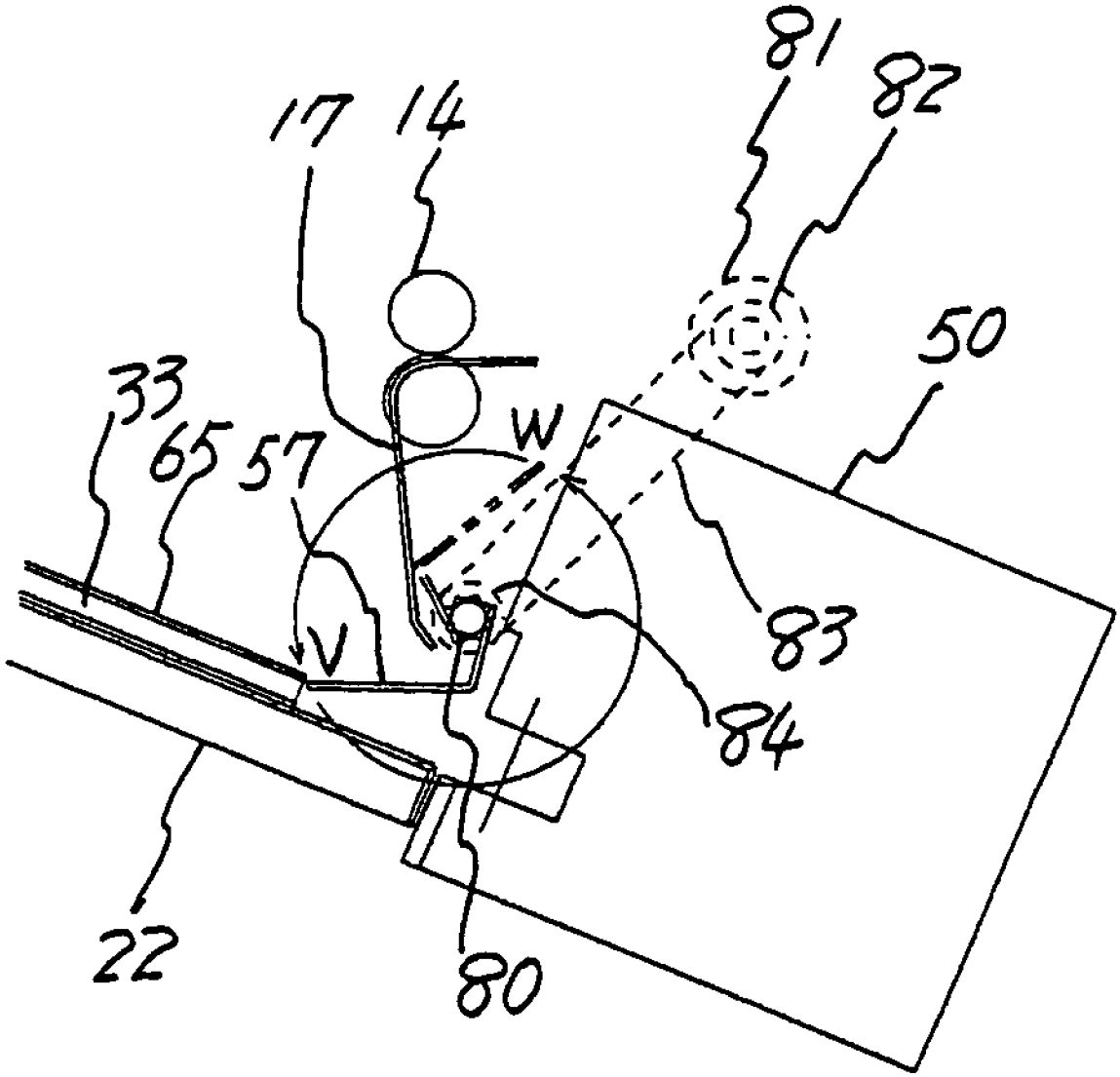
FIG. 7 is a diagram illustrating another configuration of the waiting part.

FIG. 7 illustrates another configuration of the receiving plate 57. As illustrated in FIG. 7, the receiving plate 57 is supported by a receiving plate axis 80 supported by the side plates of the main body to intermittently rotate in the arrow direction in FIG. 7. The receiving plate 57 is controlled to stop at the receiving position V illustrated in the solid line in FIG. 7 and at the retreated position W illustrated in the two-dot-dashed line in FIG. 7 by driving a pulley 84, which is fixed to the receiving plate axis 80, with a belt 83. The belt 83 is connected with a pulley 82 directly connected with a motor 81.

The discharging part 8 includes, as illustrated in FIG. 3, a discharge roller 94 rotated by a screw 90 and a screw 92 engaging with the screw 90. The screw 90 is fixed to an axis of a motor 91, mounted to the side plates of the main body.

When the binding tray 22 is moved to the lower position N illustrated in the two-dot-dashed line in FIG. 3, the discharge roller 94 is in the position of a roller hole 96 of the binding tray 22 as illustrated in FIG. 4, and a part of the discharge roller 94 comes out, through the roller hole 96, to the upper surface of the binding tray 22. Thereby, a stack of the sheets 20 on the binding tray 22 is sandwiched by the discharge roller 94 and the upper plates 65 of the left side guide plate 33 and the right side guide plate 32. The discharge roller 94 is configured such that the rotation center thereof is moved. Specifically, the discharge roller 94 is pressed by a spring such that the stack of the sheets 20 on the binding tray 22 is sandwiched by the discharge roller 94 and the upper plates 65 of the left side guide plate 33 and the right side guide plate 32 at a predetermined pressure regardless of the thickness of the stack of the sheets 20. Thereby, the stack of the sheets 20 on the binding tray 22 can be reliably discharged from the binding tray 22 onto the discharge table 70.

Figure 8:
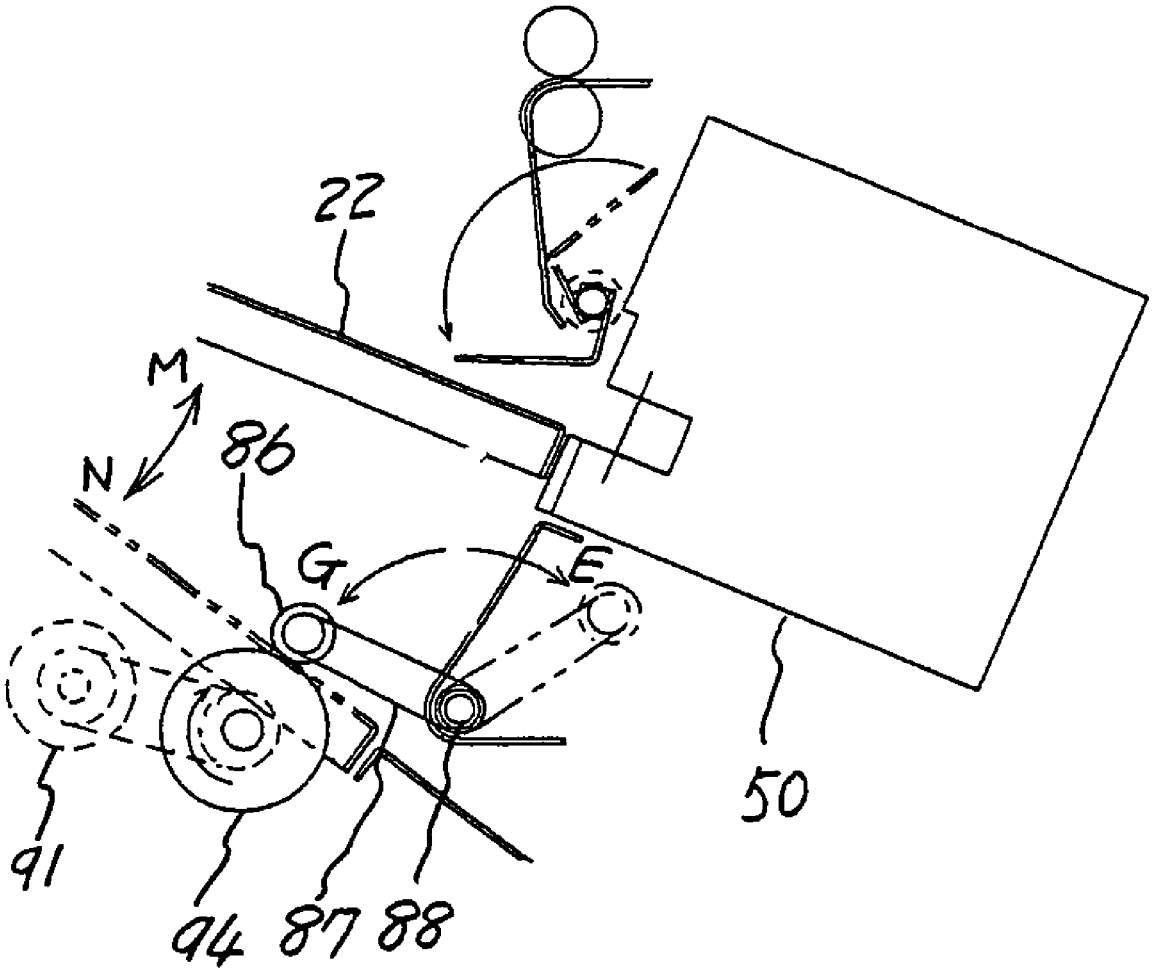
FIG. 8 is a diagram illustrating another configuration of a discharge part of the sheet processing apparatus.

FIG. 8 illustrates another configuration of the discharge part 8. The discharge roller 94 is driven to rotate by the motor 91 via a belt. An arm 87 is fixed to a rotation axis 88 fixed to the side plates of the main body with bearings, and an upper discharge roller 86 is rotatably mounted to the arm 87. The upper discharge roller 86 is moved from a position E illustrated in the two-dot-dashed line in FIG. 8 to a position G illustrated in the solid line in FIG. 8 by a solenoid (not shown). When the solenoid is not operated, the upper discharge roller 86 is positioned in the position E by a spring (not shown). After the binding tray 22 has been moved to the lower position N illustrated in the two-dot-dashed line in FIG. 8, the solenoid is operated, so that the upper discharge roller 86 is moved to the position G. Thereby, the stack of the sheets 20 on the binding tray 22 is sandwiched by the discharge roller 94 exposing through the roller hole 96 of the binding tray 22 and the upper discharge roller 86, and with rotation of the discharge roller 94, the stack of the sheets 20 on the binding tray 22 is discharged from the binding tray 22.

Now, an operation of the sheet processing apparatus 3 is described.

When the sheet processing apparatus 3 has been turned on, the binding tray 22 is positioned in the upper position M by the motor 23, the stopper 51 is positioned in the position J by turning off of the solenoid, the end plate 31 of the binding tray 22 is positioned in the criterion position P by the motor 40, the right side guide plate 32 and the left side guide plate 33 of the binding tray 22 are positioned in respective criterion positions S by the right side motor 47 and the left side motor 48, the stapler 50 is in the waiting state, and the receiving plates 57 of the waiting part 7 are positioned in the retreated positions W behind the front plate 17.

When the sheet 20 discharged from the printer 2 has been detected with the entry detector 12 of the receiving part 4, the drive motor of the main body starts to rotate, and the entry roller pair 13 and the discharge roller pair 14 start to rotate in the arrow directions in FIG. 3. The sheet 20 is conveyed by the entry roller pair 13, and is discharged by the discharge roller pair 14 from the receiving part 4 to be fallen and received on the binding tray 22. After detection of the trailing edge of the sheet 20 with the discharge detector 16, the end plate 31 moves from the criterion position P to the jogging position Q, thereby thrusting the sheet 20 against the stopper 51 in the position J, so that the trailing end portion of the sheet 20 is put into the opening part of the stapler 50 and the trailing end of the sheet 20 is aligned with the stopper 51 in the position J, and then returns to the criterion position P, and at the same time, the right side guide plate 32 and the left side guide plate 33 move from respective criterion positions S to respective widthwise jogging positions R and immediately return to the criterion positions S, so that the sides of the sheet 20 are aligned with the jogging positions R.

The next sheet 20 discharged from the printer 2 is conveyed by the entry roller pair 13 and is discharged from the receiving part 4 by the discharge roller pair 14 to be fallen on the binding tray 22. The next sheet 20 is stacked on the sheet 20 previously received on the binding tray 22. The end plate 31, the right side guide plate 32, and the left side guide plate 33 jog the next sheet 20 stacked on the previously received sheet 20 on the binding tray 22, and return to the position P and the positions S, respectively.

Similarly, the last sheet 20 to be bound, discharged from the printer 2 and received by the receiving part 4, is discharged from the receiving part 4 by the discharge roller pair 14 to be fallen on the binding tray 22, and is stacked on the previously received sheets 20 on the binding tray 22. According to an instruction from the controller 10 relative to the last sheet 20 to be bound, after the last sheet 20 has been jogged, the end plate 31, the right side guide plate 32, and the left side guide plate 33 stop at respective jogging positions to hold the stack of the sheets 20 on the binding tray 22. That is, the end plate 31 stops in the position Q, and the right side guide plate 32 and the left side guide plate 33 stop in the positions R, respectively. Then, according to an instruction from the controller 10, the stapler 50 binds the stack of the sheets 22 on the binding tray 22. Thereafter, the end plate 31 moves from the jogging position Q to the criterion position P and the solenoid 55 is operated, so that the stopper 51 is moved from the position J to the position K. Thereby, the stack of the sheets 20 on the binding tray 22, which has been bound, is pushed back by the stopper 51, so that the trailing end portion of the bound stack of the sheets 20 comes out of the opening part of the stapler 50. The stopper 51 then returns to the position J. At this time, when discharging the bound stack of the sheets 20 onto the discharge table 70 shifted in the widthwise direction of the discharge table 70, the right side guide plate 32 and the left side guide plate 33 are moved at the same time from the jogging positions R to the rear side positions F or to the front side positions H so that the bound stack of the sheets 20 is shifted on the binding tray 22 in the widthwise direction of the binding tray 22.

Thereafter, the motor 23 starts to rotate, and with rotation of the motor 23, the binding tray 22 moves from the upper position M to the lower position N, and at the same time, the discharge roller 94 is rotated with the motor 91. By movement of the binding tray 22 to the lower position N, the bound stack of the sheets 20 on the binding tray 22 is sandwiched by the discharge roller 94 and the upper plates 65 of the left side guide plate 33 and the right side guide plate 32, and with rotation of the discharge roller 94, the bound stack of the sheets 20 is discharged from the binding tray 22 onto the discharge table 70. The trailing edge of the bound stack of the sheets 20 is detected with the sheet detector 49, and thereby discharging of the bound stack of the sheets 20 from the binding tray 22 is confirmed.

The binding tray 22 then returns to the upper position M and the motor 23 stops. The stopper 51 is positioned in the position J by turning off of the solenoid 55, the right side guide plate 32 and the left side guide plate 33 move to respective criterion positions S with driving of the right side motor 47 and the left side motor 48, and the discharge roller 94 stops rotating.

When binding plural sets of the sheets 20 in series one after another, after the stapler 50 has started to bind the previous set of the sheets 20 on the binding tray 22, the receiving plate motor 59 starts to rotate and the receiving plates 57 come out through the hole of the front plate 17. Specifically, after the stapler 50 has started binding, at the same time when the entry roller pair 13 and the discharge roller pair 14 start to rotate upon detecting the next sheet 20 (the first sheet 20 of the next set of the sheets 20 to be bound) with the entry detector 12, the receiving motor 59 starts to rotate and the receiving plates 57 start to move from the retreated positions W, through the hole of the front plate 17, to the receiving positions V. Thereby, sheets 20 conveyed by the entry roller pair 13 and discharged from the receiving part 4 by the discharge roller pair 14 one after another after the stapler 50 has started binding the previous set of the sheets 20 on the binding tray 22 are received on the receiving plates 57 and the upper plates 65 of the left side guide plate 33 and the right side guide plate 32 of the binding tray 22 and are stacked on top another.

After the stapler 50 has completed binding the previous set of the sheets 20 and discharging thereof from the binding tray 22 has been confirmed with the sheet detector 49 as described above, the binding tray 22 returns to the upper position M, and the left side guide plate 33 and the right side guide plate 32 return to the criterion positions S. Thereby, the leading end sides of the sheets 20 received and held on the upper plates 65 of the left side guide plate 33 and the right side guide plate 32 are fallen on the binding tray 22. Further, at this time, the receiving plates 57 move from the receiving positions V to the retreated positions W, so that the trailing end sides of the sheets 20 held on the receiving plates 57 are fallen and received on the binding tray 22. The sheets 20 fallen on the binding tray 22 are jogged, when the next sheet 20 is discharged from the receiving part 4 onto the binding tray 22, together with the next sheet 20. Thereafter, after the last sheet 20 of the next set of the sheets 20 has been discharged onto the binding tray 22 and jogged, the next set of the sheets 20 is bound by the stapler 50 as in the previous set of the sheets 20.

FIG. 9, FIG. 10, FIG. 11, FIG. 12, FIG. 13, FIG. 14 and FIG. 15 illustrate a flowchart of an operation of the sheet processing apparatus 3 when binding plural sets of the sheets 20 in series one after another.

Figure 9:
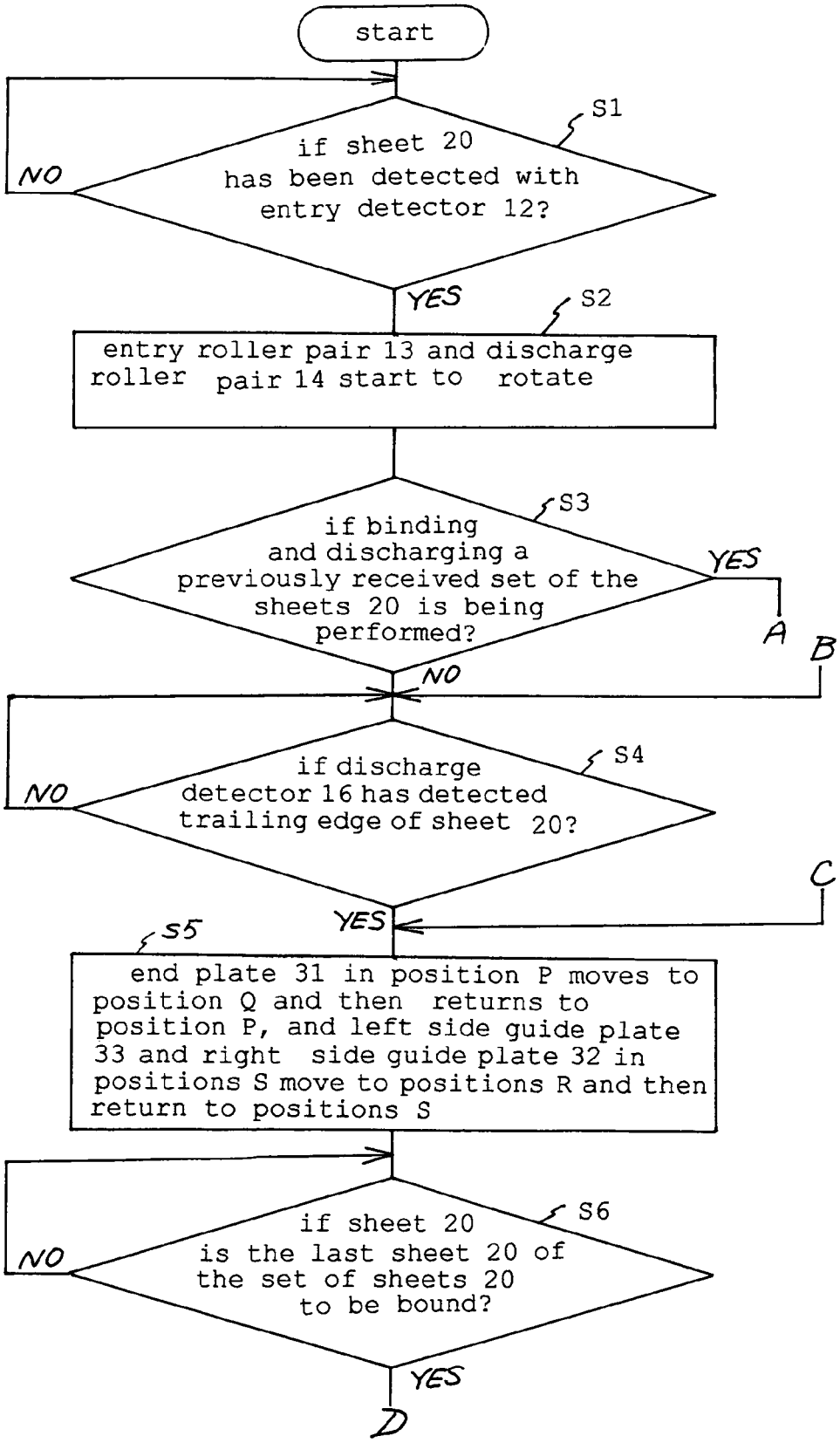
FIG. 9 is diagram illustrating a portion of a flowchart of an operation of the sheet processing apparatus when binding plural sets of sheets in series one after another.

Referring to FIG. 9, after the power of the sheet processing apparatus 3 has been turned on, it is determined if the sheet 20 has been detected with the entry detector 12 (step S1). When the sheet 20 has been detected with the entry detector 12, the entry roller pair 13 and the discharge roller pair 14 start to rotate (step S2).

It is then determined if binding and discharging a previously received set of the sheets 20 is being performed (step S3). Specifically, it is determined if any of the stapler 50, the binding tray 22, and the discharge roller 94 is being operated.

When it has been determined in step S3 that binding and discharging a previously received set of the sheets 20 is not being performed (i.e., none of the stapler 50, the binding tray 22, and the discharge roller 94 is being operated), it is then determined if the discharge detector 16 has detected the trailing edge of the sheet 20 (step S4). When the discharge detector 16 has detected the trailing edge of the sheet 20, the end plate 31 in the criterion position P moves to the jogging position Q and then returns to the criterion position P, and the left side guide plate 33 and the right side guide plate 32 in the criterion positions S move to the jogging positions R and then return to the criterion positions S (step S5).

Then, it is determined if the sheet 20 is the last sheet 20 of the set of the sheets 20 to be bound (step S6). When it has been determined in step S6 that the sheet 20 is the last sheet 20 of the set of the sheets 20 to be bound, referring to FIG. 10, the entry roller pair 13 and the discharge roller pair 14 stop rotating, the end plate 31 in the criterion position P moves to the jogging position Q, and the left side guide plate 33 and the right side guide plate 32 in the criterion positions S move to the jogging positions R (step S7).

It is then determined if binding is to be performed with the stapler 50 relative to the set of the sheets 20 on the binding tray 22 (step S8). When it has been determined in step S8 that binding is to be performed, the stapler 50 binds the set of the sheets 20 on the binding tray 22 (step S9).

Thereafter, the end plate 31 moves from the jogging position Q to the criterion position P, and the stopper 51 in the position J moves to the position K, thereby pushing back the bound set of the sheets 20 on the binding tray 22, and returns to the position J (step S10).

Then, it is determined if a shifting operation is to be performed to shift the bound set of the sheets 20 on the binding tray 22 in the widthwise direction of the binding tray 22 (step S11). When it has been determined in step S11 that the shifting operation is to be performed, referring to FIG. 13, it is determined if the bound set of the sheets 20 on the binding tray 22 is to be shifted to this side of the binding tray 22 on the binding tray 22 (step S12). When it has been determined that the bound set of the sheets 20 is to be shifted to this side, the left side guide plate 32 and the right side guide plate 33 are moved from the jogging positions R to the front side positions H (step S13) and thereby the bound set of the sheets 20 on the binding tray 22 is moved to this side of the binding tray 22 on the binding tray 22, and when it has been determined that the bound set of the sheets 20 is not to be shifted to this side, the left side guide plate 33 and the right side guide plate 32 are moved from the jogging potions R to the rear side positions F (step S14) and thereby the bound set of the sheets 20 is moved to the rear side of the binding tray 22.

Thereafter, referring back to FIG. 10, the binding tray 22 is moved from the upper position M to the lower position N, and the discharge roller 94 starts to rotate (step S15), so that the bound set of the sheets 20 on the binding tray 22 is discharged from the binding tray 22 onto the discharge table 70. Then, it is determined if the sheet detector 49 has detected the trailing edge of the bound set of the sheets 20 (step S16). When it has been determined that the sheet detector 49 has detected the trailing edge of the bound set of the sheets 20, referring to FIG. 11, the binding tray 22 moves from the lower position N to the upper position M, the left side guide plate 33 and the right side guide plate 32 move to the criterion positions S, and the discharge roller 94 stops rotating (step S17,) and the process returns to the start (step S18).

Figure 12:
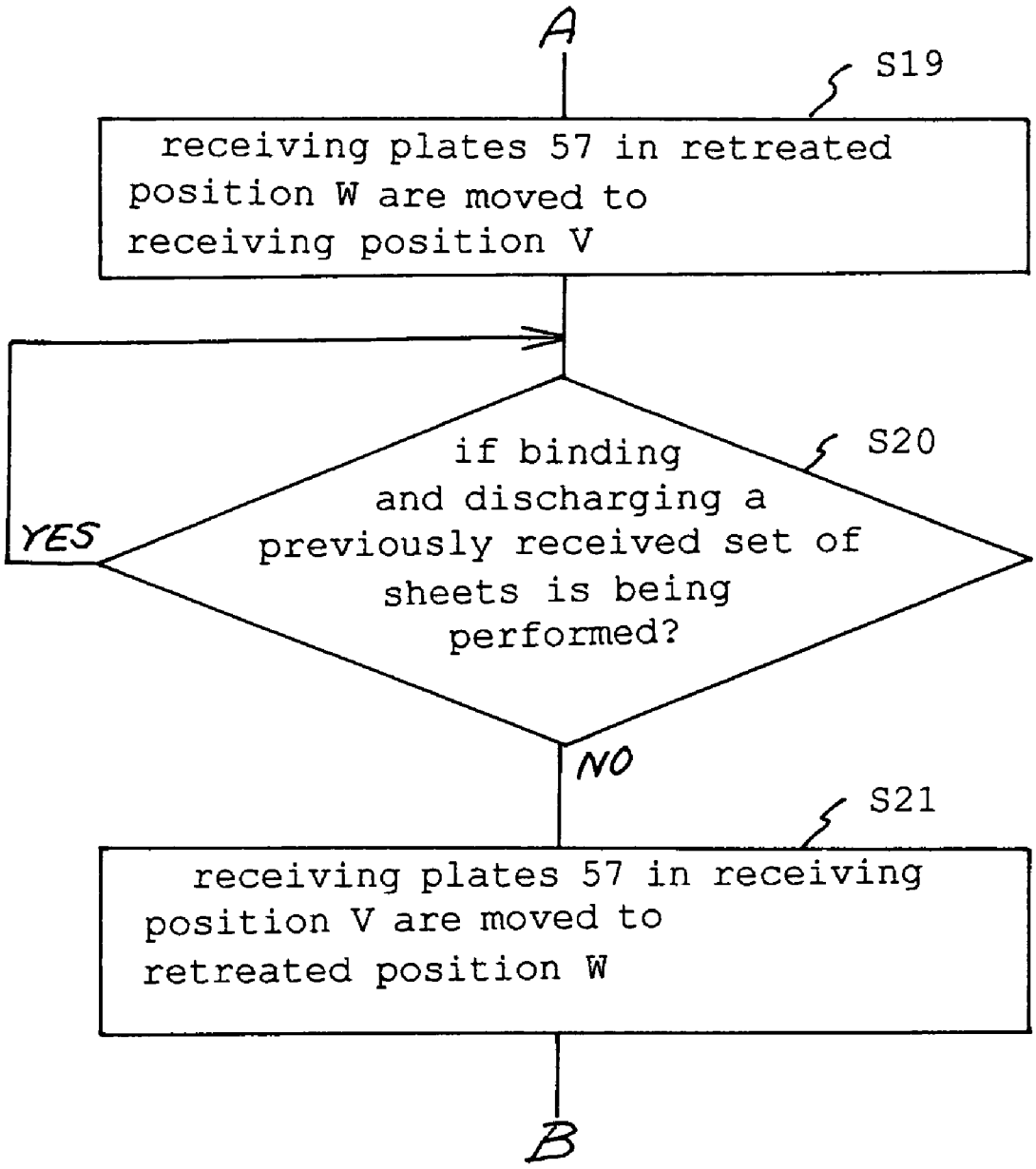
FIG. 12 is a diagram illustrating still another portion of the flowchart.
Figure 13:
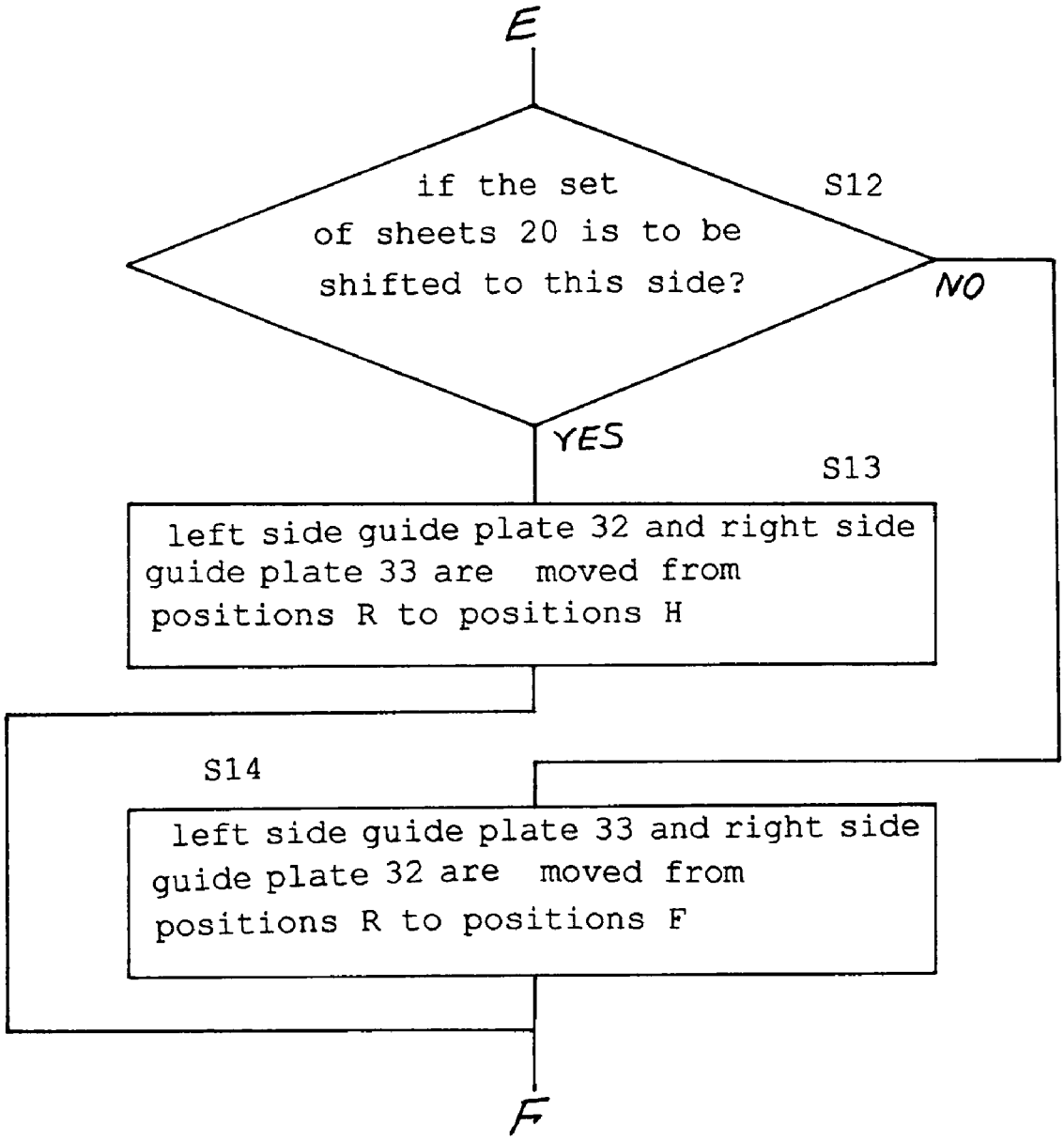
FIG. 13 is a diagram illustrating still another portion of the flowchart.

When it has been determined in step S3 (FIG. 9) that binding and discharging a previously received set of the sheets 20 is being performed, that is, the stapler 50 has started binding the previously received set of the sheets 20 on the binding tray 22, and discharging the previously received set of the sheets 20 from the binding tray 22 has not been completed and the binding tray 22 has not yet returned to the upper position M, referring to FIG. 12, the receiving plates 57 in the retreated positions W are moved to the receiving positions V (step S19). Thereby, sheets 20 discharged from the printer 2, received by the receiving part 4, and discharged by the discharge roller pair 14 from the receiving part 4 one after another thereafter are received, stacked one upon another and held on the receiving plates 57 in the receiving positions V and the upper plates 65 of the left side guide plate 33 and the right side guide plate 32 of the binding tray 22. The trailing end sides of the sheets 20 are on the receiving plates 57 and the leading end sides of the sheets 20 are on the upper plates 65 of the left guide plate 33 and the right side guide plate 32.

Thereafter, it is determined if binding and discharging a previously received set of the sheets 20 is being performed (step S20). When it has been determined in step S20 that binding and discharging a previously received set of the sheets 20 is not being performed (that is, binding the previously received set of the sheets 20 on the binding tray 22 and discharging the bound set of the sheets 20 from the binding tray 22 has been completed and the binding tray 22 has returned to the upper position M), the receiving plates 57 in the receiving positions V are moved to the retreated positions W (step S21). Thereby, the trailing end sides of the sheets 20 held on the receiving plates 57 fall on the binding tray 22. At this time, the leading end sides of the sheets 20 held on the upper plates 65 of the left side guide plate 33 and the right side guide plate 32 have been already fallen on the binding tray 22 when the left side guide plate 33 and the right side guide plate 32 have returned to the criterion positions S, so that the sheets 20 are received on the binding tray 22. The process then proceeds to step S4 (FIG. 9) and thereafter.

Figure 10:
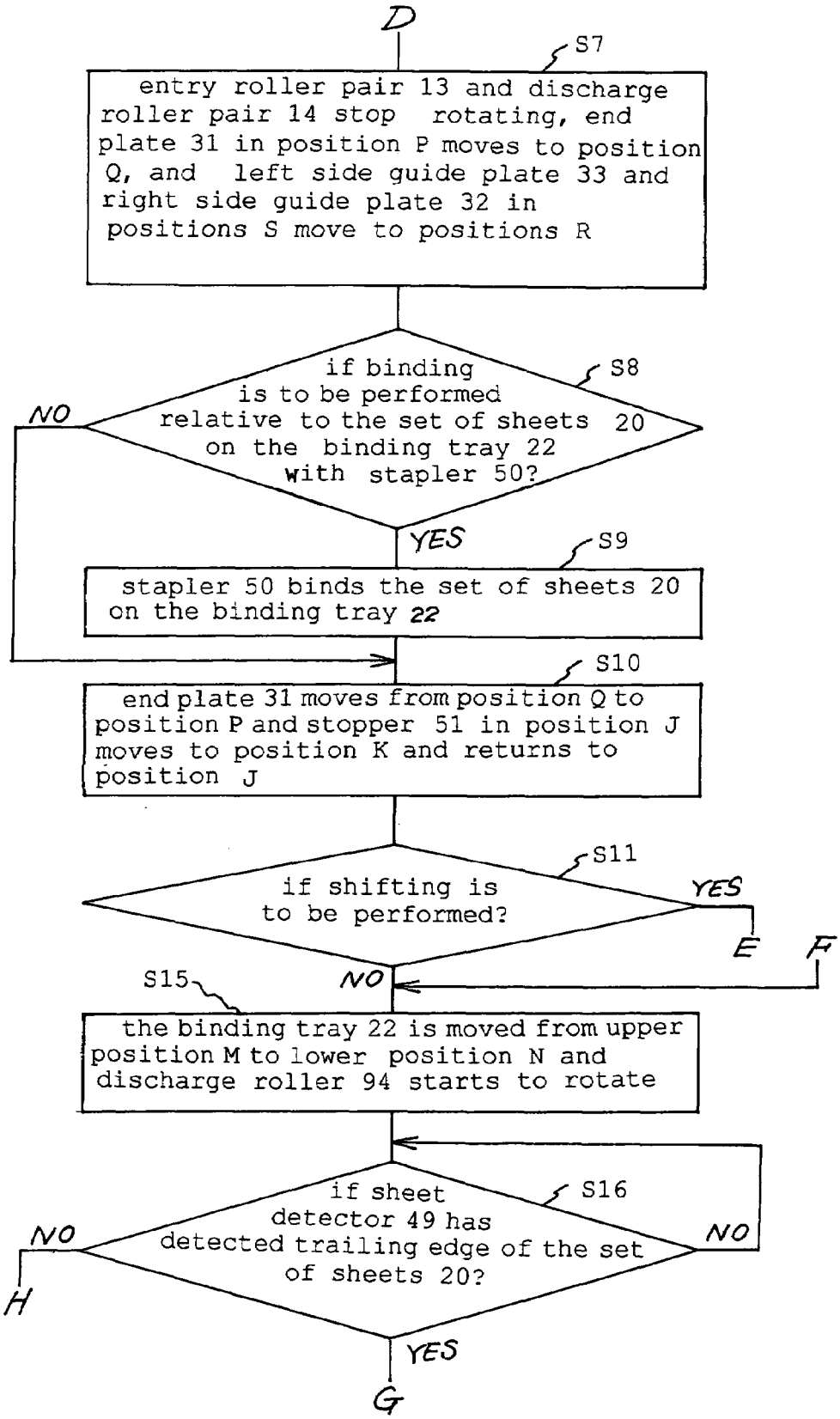
FIG. 10 is a diagram illustrating another portion of the flowchart.
Figure 11:
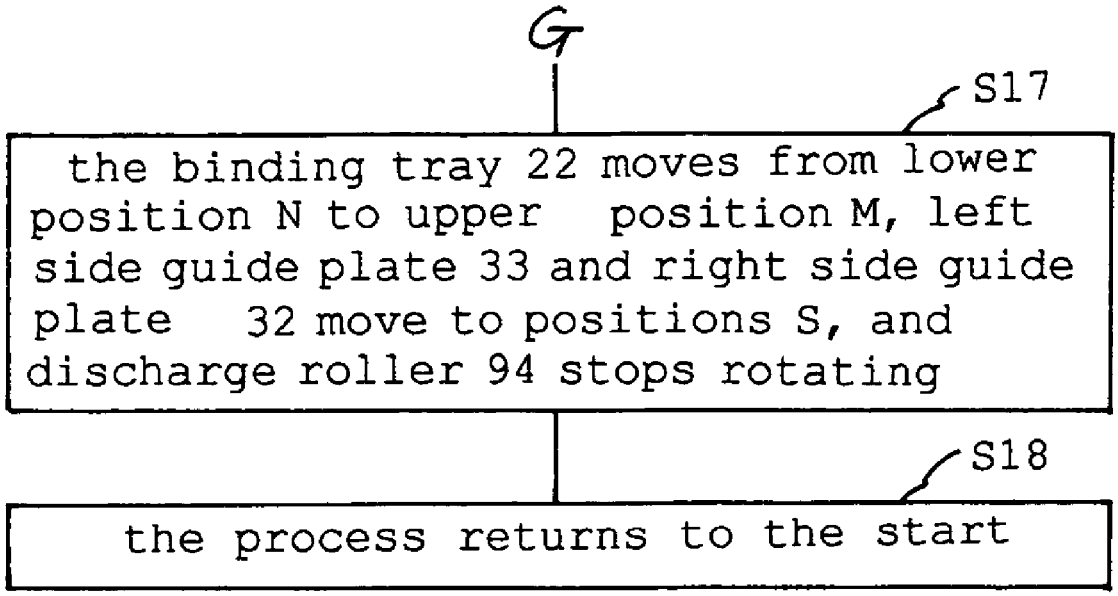
FIG. 11 is a diagram illustrating still another portion of the flowchart.

Referring to FIG. 10, when it has been determined in step S8 that binding is not to be performed, the process skips binding with the stapler 50 in step S9 and proceeds to step S10. In this case, by performing the operations in step S11, and step S12 through step S14 (FIG. 13), the set of the sheets 20 on the binding tray 22 is discharged, without being bound, onto the discharge table 70 shifted in the widthwise direction of the discharge table 70 on the discharge table 70.

Figure 14:
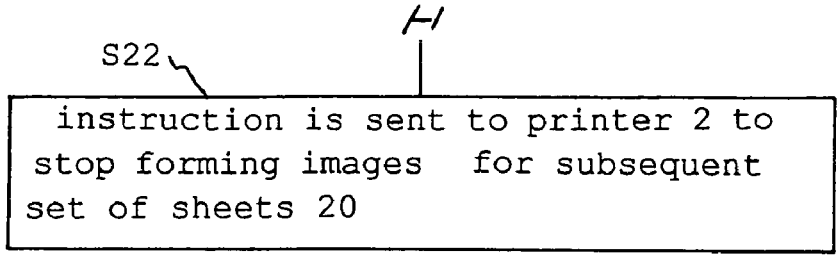
FIG. 14 is a diagram illustrating still another portion of the flowchart.
Figure 15:
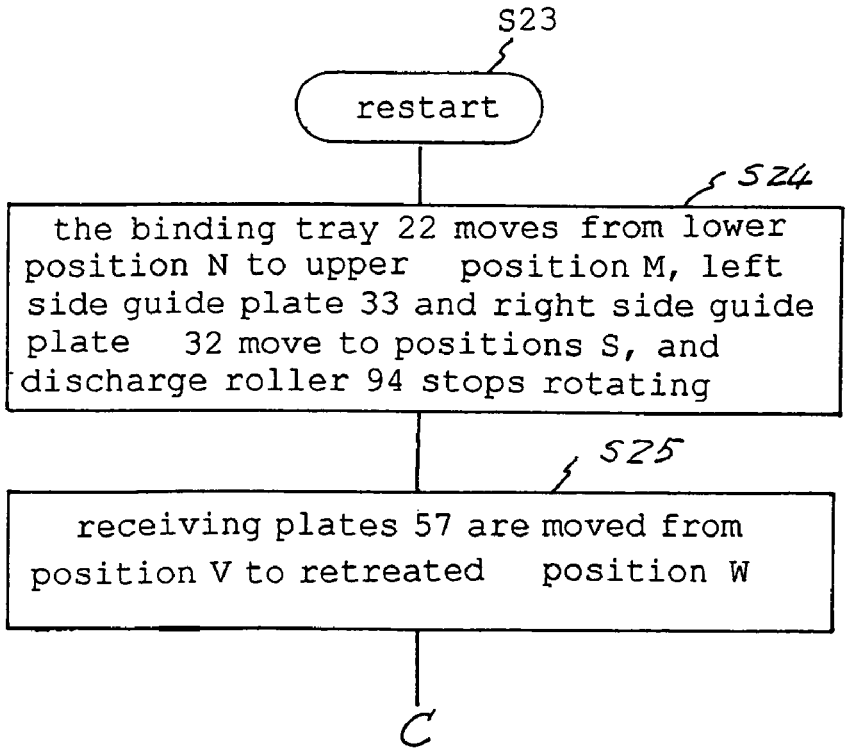
FIG. 15 is a diagram illustrating still another portion of the flowchart.

Still referring to FIG. 10, when the sheet detector 49 has not detected the trailing edge of the bound set of the sheets 20 within a predetermined period of time in step S16, such as when the bound set of the sheets 20 on the binding tray 22 has not been properly discharged from the binding tray 22 due to accumulation of previously discharged sets of the sheets 20 on the discharge table 70, referring to FIG. 14, it is determined as that a malfunction has occurred, and an instruction is sent to the printer 2 to stop forming images for a subsequent set of the sheets 20 following the next set of the sheets 20 following the bound set of the sheets 20 (step S22). In this case, sheets 20 of the next set of the sheets 20 discharged from the printer 2 one after another are received on the receiving plates 57 and the upper plates 65 of the left side guide plate 33 and the right side guide plate 32 of the binding tray 22 one after another to be stacked on top of another and are held thereon. After removing the previously discharged sets of the sheets 20 on the discharge table 70 and the set of the sheets 20 on the binding tray 22 which has not be discharged from the binding tray 22, referring to FIG. 15, by depressing a restart button of the sheet processing apparatus 3 (step S23), the binding tray 22 is moved from the lower position N to the upper position M, the left side guide plate 33 and the right side guide plate 32 are moved to the criterion positions S, and the discharge roller 94 stops rotating (S24), and the receiving plates 57 are moved from the receiving positions V to the retreated positions W (S25), and thereby the next set of the sheets 20 held on the receiving plates 57 and the upper plates 65 of the left side guide plate 33 and the right side guide plate 32 falls on the binding tray 22, and the process proceeds to step S5 (FIG. 9) and thereafter.

As described above, in the above-described sheet processing apparatus 3, when binding a plurality of sets of the sheets 20 in series one after another, the sheet receiving plates 57 of the waiting part 7 receive and hold sheets 20 received by and discharged from the sheet receiving part 4 one after another after the stapler 50 has started binding a previously received set of sheets 20 on the binding tray 22 and before the binding tray 22 has returned to the upper position M, and releases the held sheets 20 to be fallen and received on the binding tray 22 after the bound set of the sheets 20 has been discharged from the binding tray 22 and the binding tray 22 has returned to the upper position M. Therefore, even when the processing speed of the sheet processing apparatus 3 is not comparable to that of the printer 2 and sheets 20 following a previously received set of sheets 20 are discharged from the printer 2 before the binding tray 22 has returned to the upper position M, the sheets 20 are received and held on the sheet receiving plates 57 until the binding tray 22 returns to the upper position M, so that it is not necessary to control the printer 2 to stop forming images temporarily for the next set of sheets 20, and thereby decreasing the productivity of the printer 2 is avoided. It is not necessary either to arrange a sheet waiting apparatus between the sheet processing apparatus 3 and the printer 2 to avoid that the printer 2 is caused to temporarily stop forming images.

Further, when a malfunction has occurred in the sheet processing apparatus 3, such as when a bound set of sheets 20 has not been properly discharged from the binding tray 22, an instruction is sent to the printer 2 to stop forming images for the subsequent set of sheets 20 following the next set of sheets 20 following the bound set of sheets 20 on the binding tray 22, and sheets 20 of the next set of sheets 20 discharged from the printer 2 one after another and received by the receiving part 4 are received on the receiving plates 57 to be stacked on top of another. That is, the printer 2 is not caused to stop forming images for the next set of sheets 20, so that it is avoided that several sheets 20 of the next set of sheets 20 remain in the sheet conveyance path of the printer 2. Thus, a trouble of removing the sheets 20 remained in the printer 2 is avoided.

Further, each bound set of sheets 20 on the binding tray 22 can be shifted, before being discharged from the binding tray 22, to one or the other side of the binding tray 22 in the widthwise direction of the binding tray 22, so that when processing a plurality of sets of sheets 20 in series one after another, the plurality of sets of sheets 20 are stacked on top of another on the discharge table 70 shifted to alternate sides of the discharge table 70 in the widthwise direction of the discharge table 70 and thereby separating one from another is facilitated even when each bound set of sheets 20 is relative thin.

Further, the waiting part 7 as the sheet holding device of the present invention is arranged between the discharge roller pair 16 of the receiving part 4 and the stapler 50 and is configured such that one end side of each sheet 20 discharged from the receiving part 4 is received on the sheet receiving plates 57 and the other end side of the sheet 20 is received on the binding tray 22, so that the sheet processing apparatus 3 is made relatively compact. Furthermore, by effectively using the space above the binding tray 22, receiving and holding a relatively large volume of sheets 20 is realized.

Numerous additional modifications and variations of the present invention are possible in light of the above-teachings. It is therefore to be understood that within the scope of the claims, the present invention can be practiced otherwise than as specifically described herein.

What is claimed is:

1. A sheet processing apparatus, comprising:

a receiving device configured to receive sheets discharged from an image forming apparatus one after another and to convey the sheets, the receiving device including a discharge roller pair to discharge the sheets in a first direction from the receiving device one after another;

a binding tray configured to receive the sheets discharged from the receiving device one after another to be stacked one on top of another thereon, the binding tray including a widthwise jogging device configured to move between a jogging position and a criterion position to jog each sheet received on the binding tray, as the sheet is received thereon, at widthwise sides of the sheet in a direction in which the sheet has been conveyed by the receiving device;

a binding device configured to bind a set of the sheets received, stacked, and jogged on the binding tray;

a discharge device configured to discharge the bound set of the sheets from the binding tray;

a binding tray moving mechanism for moving the binding tray about a support axis between a receiving position and a discharging position, wherein the binding tray is moved to the receiving position when receiving the sheets discharged from the receiving device one after another thereon to be stacked one on top of another and jogging each sheet received on the binding tray with the widthwise jogging device as the sheet is received thereon and when the set of the sheets has been received, stacked, and jogged on the binding tray and bound by the binding device, the binding tray is rotated in a vertical direction with respect to the first direction in which the sheet has been conveyed by the receiving device, to the discharging position for discharging the bound set of the sheets from the binding tray, and returned to the receiving position after the bound set of the sheets has been discharged from the binding tray; and a sheet holding device including a moving mechanism for moving the sheet holding device in the first direction in which the sheet is conveyed by the receiving device, to a holding position in a path between the discharge roller pair of the receiving device and the binding device and in a reverse direction to a non-holding position outside of the path between the discharge roller pair of the receiving device and the binding device and configured to receive sheets, discharged from the receiving device one after another after the binding device has started binding the set of the sheets on the binding tray and before the binding tray has returned from the discharging position to the receiving position, one after another to be stacked one on top of another and to be held thereon, and to release the held sheets to be fallen and received on the binding tray after the binding tray has returned from the discharging position to the receiving position.

2. The sheet processing apparatus according to claim 1, wherein the sheet holding device is configured to retreat to the non-holding position to release the held sheets to be fallen on the binding tray.

3. The sheet processing apparatus according to claim 1, wherein the sheet holding device is configured such that trailing end sides of the sheets, discharged from the receiving device one after another after the binding device has started binding the set of the sheets on the binding tray and before the binding tray has returned from the discharging position to the receiving position, are received and held thereon, and the widthwise jogging device of the binding tray includes upper plates and is configured such that leading end sides of the sheets, discharged from the receiving device one after another after the binding device has started binding the set of the sheets on the binding tray and before the binding tray has returned from the discharging position to the receiving position, are received and held on the upper plates of the widthwise jogging device.

4. The sheet processing apparatus according to claim 3, wherein the widthwise jogging device of the binding tray is configured to be in the jogging position to hold the set of the sheets on the binding tray when the set of the sheets on the binding tray is bound by the binding device and to be returned to the criterion position after the binding tray has returned to the receiving position after the bound set of the sheets has been discharged from the binding tray.

5. The sheet processing apparatus according to claim 1, wherein the binding tray includes a lengthwise jogging device configured to jog each sheet received on the binding tray, as the sheet is received on the binding tray, in the direction in which the sheet has been conveyed by the receiving device, wherein the binding device includes an opening part into which a trailing end side portion of each sheet received on the, binding tray is put into when the sheet is jogged by the lengthwise jogging device, and wherein the sheet holding device is configured to prevent trailing end side portions of the received and held sheets from being put into the opening part of the binding device.

6. The sheet processing apparatus according to claim 1, wherein the widthwise jogging device of the binding tray includes widthwise jogging members configured to move between respective criterion positions and widthwise jogging positions to jog each sheet received on the binding tray at the widthwise sides of the sheet as the sheet is received on the binding tray and individual drive devices configured to drive the widthwise jogging members to move between respective criterion positions and widthwise jogging positions.

7. The sheet processing apparatus according to claim 6, wherein the widthwise jogging members of the jogging device are configured to be driven to move substantially at a same time in a same direction in a widthwise direction of the binding tray in the direction in which the bound set of the sheets on the binding tray is discharged from the binding tray to shift the bound set of the sheets on the binding tray to one or the other side of the binding tray in the widthwise direction of the binding tray.

8. The sheet processing apparatus according to claim 7, wherein when binding a plurality of sets of sheets in series one after another, after the plurality of set of sheets have been bound by the binding device one after another, the widthwise jogging members of the widthwise jogging device are moved in alternate directions in the widthwise direction of the binding tray, so that the plurality of sets of the sheets are shifted to alternate sides of the binding tray in the widthwise direction of the binding tray before being discharged from the binding tray one after another.

9. The sheet processing apparatus according to claim 1, wherein when the bound set of the sheets has not been discharged from the binding tray in a predetermined period of time, an instruction is sent to the image forming apparatus to stop forming images for a subsequent set of sheets following a next set of sheets following the bound set of the sheets, so that the next set of sheets following the bound set of the sheets, discharged from the image forming apparatus, is received and held on the sheet holding device.

10. The sheet processing apparatus according to claim 9, wherein the sheet holding device is configured to release the next set of sheets received and held thereon to be fallen and received on the binding tray when the apparatus has restarted to operate.

11. A sheet processing apparatus, comprising:

receiving/conveying means for receiving sheets discharged from an image forming apparatus one after another and conveying the sheets in a first direction, the receiving/conveying means including discharging means for discharging the sheets from the receiving/conveying means one after another;

receiving means for receiving the sheets discharged from the receiving/conveying means one after another to be stacked one on top of another thereon, the receiving means including widthwise jogging means for jogging each sheet received on the receiving means, as the sheet is received thereon, at widthwise sides of the sheet in a direction in which the sheet has been conveyed by the receiving/conveying means by moving between a jogging position and a criterion position;

binding means for binding a set of the sheets received, stacked, and jogged on the receiving means;

bound set discharging means for discharging the bound set of the sheets from the receiving means;

binding tray moving means for moving the receiving means about a support axis between a receiving position and a discharging position, wherein the receiving means is moved to the receiving position when receiving the sheets discharged from the receiving/conveying means one after another thereon to be stacked one on top of another and jogging each sheet received on the receiving means with the widthwise jogging means as the sheet is received thereon and when the set of the sheets has been received, stacked, and jogged on the binding tray and bound by the binding means, the receiving means is rotated in a vertical direction with respect to the first direction in which the sheet has been conveyed by the receiving/conveying means, to the discharging position for discharging the bound set of the sheets from the receiving means, and returned to the receiving position after the bound set of the sheets has been discharged from the receiving means; and sheet holding means including a moving mechanism for moving the sheet holding means in the first direction in which the sheet is conveyed by the receiving/conveying means, to a holding position in a path between the discharging means of the receiving/conveying means and the binding means and in a reverse direction to a non-holding position outside of the path between the discharge means and the binding means, the sheet holding means for receiving sheets, discharged from the receiving/conveying means one after another after the binding means has started binding the set of the sheets on the receiving means and before the receiving means has returned from the discharging position to the receiving position, one after another to be stacked one on top of another, holding the sheets, and releasing the held sheets to be fallen and received on the receiving means after the receiving means has returned from the discharging position to the receiving position.

12. A method of processing sheets in a sheet processing apparatus, comprising:

receiving sheets discharged from an image forming apparatus one after another in a first direction on a tray to be stacked one on top of another and jogging each sheet as the sheet is received on the tray;

binding a set of the sheets received, stacked, and jogged on the tray;

discharging the bound set of the sheets from the tray;

moving a holding device in the first direction in which the sheet is discharged, to a holding position;

receiving and holding sheets on the holding device, the sheets discharged from the image forming apparatus one after another after binding of the set of sheets on the tray has started and before discharging the bound set of sheets from the tray has been completed, wherein the sheets are stacked one on top of another on the holding device;

moving the holding device in a reverse direction to a non-holding position; and releasing the sheets stacked and held on the holding device to fall and be received on the tray, after discharging of the bound set of sheets from the tray has been completed, wherein the tray is rotated in a vertical direction with respect to the first direction in which the sheet has been discharged to a discharging position when discharging the bound set of sheets.

13. The method according to claim 12, further comprising shifting the bound set of the sheets on the tray, before discharging the bound set of the sheets from the tray, to one or the other side of the tray in a widthwise direction of the tray in a direction in which the bound set of the sheets is discharged from the tray.

14. The method according to claim 13, wherein when processing a plurality of sets of sheets in series one after another, in the shifting, the plurality of sets of sheets are shifted to alternate sides of the tray in the widthwise direction of the tray.

15. The method according to claim 12, further comprising instructing the image forming apparatus to stop forming images for a subsequent set of sheets following a next set of sheets following the bound set of the sheets, when the bound set of the sheets has not been discharged from the tray within a predetermined period of time in the discharging.

* * * * *